US008375863B2

(12) United States Patent
Roodenburg et al.

(10) Patent No.: US 8,375,863 B2
(45) Date of Patent: Feb. 19, 2013

(54) AMUSEMENT RIDE INSTALLATION

(75) Inventors: Joop Roodenburg, Delft (NL); Petrus Joseph Hubertus Clerx, Roermond (NL)

(73) Assignee: Vekoma Rides Engineering B.V., Vlodrop (NL)

( * ) Notice: Subject to any disclaimer, the term of this patent is extended or adjusted under 35 U.S.C. 154(b) by 408 days.

(21) Appl. No.: 12/667,812

(22) PCT Filed: Jul. 6, 2007

(86) PCT No.: PCT/NL2007/000172

§ 371 (c)(1),
(2), (4) Date: Apr. 7, 2010

(87) PCT Pub. No.: WO2009/008699

PCT Pub. Date: Jan. 15, 2009

(65) Prior Publication Data

US 2010/0207083 A1 Aug. 19, 2010

(51) Int. Cl.
*A63G 1/00* (2006.01)

(52) U.S. Cl. ..... 104/53; 472/43

(58) Field of Classification Search ..... 104/53, 104/57, 81; 472/35; 446/435, 444
See application file for complete search history.

(56) References Cited

U.S. PATENT DOCUMENTS

| | | | | |
|---|---|---|---|---|
| 4,836,521 | A * | 6/1989 | Barber | 472/13 |
| 5,658,201 | A * | 8/1997 | Kleimeyer et al. | 472/44 |
| 6,439,129 | B2 * | 8/2002 | Begotti | 104/63 |
| 2002/0100642 | A1 * | 8/2002 | Mehrman et al. | 185/14 |
| 2003/0203759 | A1 * | 10/2003 | Begotti | 472/88 |
| 2007/0265103 | A1 * | 11/2007 | Roodenburg et al. | 472/43 |
| 2008/0051205 | A1 * | 2/2008 | Roodenburg et al. | 472/43 |
| 2008/0202374 | A1 * | 8/2008 | Muller et al. | 104/53 |
| 2010/0207083 | A1 * | 8/2010 | Roodenburg et al. | 254/133 R |

FOREIGN PATENT DOCUMENTS

EP 1 358 919 A1 11/2003

* cited by examiner

*Primary Examiner* — Jason C Smith
(74) *Attorney, Agent, or Firm* — Birch, Stewart, Kolasch & Birch, LLP

(57) ABSTRACT

An amusement ride includes at least one passenger carrier, an amusement ride guide structure and a launch system adapted to accelerate the at least one passenger carrier from a starting position. The launch system includes a launch guide structure having a curvature, a launch arm rotatable about a rotation axis, an engagement device for providing a temporary connection between the launch arm and the at least one passenger carrier during the launch, and a launch drive providing the launch arm with an angular velocity. In the launch system, the radial distance between the engagement device and the launch arm support is variable such that portions of the launch guide structure have a deviating radius, or the distance in axial direction between the engagement device and the launch arm support is variable such that portions of the launch guide structure have curvatures perpendicular to the surface of rotation.

27 Claims, 3 Drawing Sheets

AMUSEMENT RIDE INSTALLATION

BACKGROUND OF THE INVENTION

The present invention relates to an amusement ride installation, comprising at least one passenger carrier adapted for supporting one or more passengers, an amusement ride guide structure supporting and guiding the at least one passenger carrier and a launch system adapted to accelerate the at least one passenger carrier from a starting position. Said launch system comprises a launch guide structure extending between the starting position and the amusement ride guide structure, supporting and guiding the at least one passenger carrier, which launch guide structure has a curvature, a launch arm connected to a launch arm support, rotatable about a rotation axis in a rotation surface, engagement means, at least part of which are associated with the launch arm, for providing a temporary connection between the launch arm and the at least one passenger carrier during the launch, which disengage at a disengagement position, and launch drive means providing the launch arm with an angular velocity.

Many types of launch systems for amusement ride installations are known. A launch system comprising a straight launch structure is known e.g. from WO 2006/004392 from the same applicant. Alternatively, launch structures comprising an inclined plane of ascending gradient with chains or steel cables and consequent lifting mechanical transmission are conventionally used. A disadvantage of such known straight launch guide structures is that a relatively large amount of space (up to 80 meters) is required for the launch, which is not always available and is at the expense of amusement ride guide structure.

In EP 1 358 919 an amusement ride installation is presented. The amusement ride installation comprises an initial trace with arc of circumference substantially vertically developed. Means so as to push the cars on the trace are driven by a counterweight.

SUMMARY OF THE INVENTION

The aim of the present invention is to provide an improved amusement ride installation with a launch system.

An improved amusement ride installation according to the present invention is according to a first aspect of the invention achieved by providing an amusement ride installation comprising:

- at least one passenger carrier adapted for supporting one or more passengers,
- an amusement ride guide structure supporting and guiding the at least one passenger carrier,
- a launch system adapted to accelerate the at least one passenger carrier from a starting position, said launch system comprising:
  - a launch guide structure extending between the starting position and the amusement ride guide structure, supporting and guiding the at least one passenger carrier, which launch guide structure has a curvature,
  - a launch arm connected to a launch arm support, rotatable about a rotation axis in a rotation surface,
  - engagement means, at least part of which are associated with the launch arm, for providing a temporary connection between the launch arm and the at least one passenger carrier during the launch, which disengage at a disengagement position,
  - launch drive means providing the launch arm with an angular velocity, wherein the radial distance between the engagement means and the launch arm support is variable such that portions of the launch guide structure have a deviating radius.

According to a second aspect of the invention, an improved amusement ride installation is achieved by providing an amusement ride installation comprising:

- at least one passenger carrier adapted for supporting one or more passengers,
- an amusement ride guide structure supporting and guiding the at least one passenger carrier,
- a launch system adapted to accelerate the at least one passenger carrier from a starting position, said launch system comprising:
  - a launch guide structure extending between the starting position and the amusement ride guide structure, supporting and guiding the at least one passenger carrier, which launch guide structure has a curvature,
  - a launch arm connected to a launch arm support, rotatable about a rotation axis in a rotation surface,
  - engagement means, at least part of which are associated with the launch arm, for providing a temporary connection between the launch arm and the at least one passenger carrier during the launch, which disengage at a disengagement position,
  - launch drive means providing the launch arm with an angular velocity, wherein the distance in axial direction between the engagement means and the launch arm support is variable such that portions of the launch guide structure have curvatures perpendicular to the surface of rotation, such as slopes or banking.

An advantage of both launch systems according to the invention is that the launch guide structure has no longer to be tailored exactly to the launch arm, and hence does no longer have to describe a perfect portion of a circle having a radius corresponding to the distance between the rotation axis and the engagement means. The present invention enables deviations in the curvature of the launch guide structure such as curvatures, bulges and bumps, but also banking. Such deviating launch guide structures attribute to the sense of excitement of the passenger during the launch. A further advantage is the reduced area required for the launch: in an exemplary embodiment, the space required for a launch system according to the invention is about 30 meters, whereby the radius for the launch curve may be 6-12 meters. The rotation axis according to the invention preferably is substantially vertical, resulting in a substantially horizontal rotation surface.

An advantage of the radial distance between the engagement means and the launch arm support being variable is that the rotating axis may be provided eccentric. The position of the rotating axis is preferably optimized to a desired tangential velocity of from the at least one passenger carrier at the disengagement position. Preferably, the radial distance between the engagement means and the launch arm support is allowed to increase from a relatively small distance at the starting position to a relatively large distance at the disengagement position. The launch drive means may provide a constant angular velocity to the launch arm, resulting in an increased tangential velocity of the at least one passenger carrier upon increase of the radial distance between the engagement means and the launch arm support. Thus, although the general shape of the launch guide structure remains the shape of a portion of a circle, this radius may according to the invention deviate during the launch due to the launch arm being radially extendable in the radial outward direction. As a result, the rotation axis is eccentric in portions of the launch guide structure.

The advantage of the distance in axial direction between the engagement means and the launch arm support being variable is that portions of the launch guide structure have curvatures perpendicular to the surface of rotation, such as slopes or banking. If the radial distance between the engagement means and the launch arm support is not variable, the launch guide structure according to this aspect of the invention having a constant radius is positioned on an imaginary surface of a sphere having he launch arm support as a centre and the radial distance between the engagement means and the launch arm support as a radius. Preferably, the radial distance between the engagement means and the launch arm support is variable to enable multiple positions of the launch guide structure.

In a preferred embodiment the engagement means are provided at the radial outer end of a straight rotatable launch arm. According to the first aspect of the invention, this rotatable launch arm is preferably made extendable in the radial outward direction, e.g. by using a telescopic launch arm. As a result, the rotation axis in this embodiment is eccentric in at least a portion of the launch guide structure. The telescopic movements of the launch arm are preferably controlled by telescopic drive means to extend the arm e.g. from the starting position to the disengagement position, and then to retract the arm from the disengagement position to the starting position.

Alternatively, the engagement means are provided at the radial outer end of a rotatable launch arm comprising multiple pivotably interconnected launch arm portions, which launch arm portions are pivotable about a pivot axis, which pivot axis extends in the rotation surface and/or perpendicular to the rotation surface. By providing a pivot axis perpendicular to the rotation surface, the radial distance between the engagement means and the launch arm support is made variable according to the first aspect of the invention. By providing a pivot axis in the rotation surface, the distance in axial direction between the engagement means and the launch arm support is variable according to the second aspect of the invention. In a preferred embodiment, multiple pivot axis are provided to combine the effects of the first and second aspect of the invention. Preferably, such pivoting movements are controlled by separately provided pivot drive means.

A variation in distance in axial direction between the engagement means and the launch arm support according to the second aspect of the invention can alternatively be accomplished by connecting a rotatable launch arm pivotably to the launch arm support about a pivot axis in the rotation surface, so as to allow the launch arm to pivot in a direction perpendicular tot he rotation surface. Such pivoting movement may be controlled by pivot drive means.

Hence, in preferred embodiments the engagement means are provided at the radial outer end of the launch arm. At least part of the engagement means are associated with the launch arm, which may engage directly with a passenger carrier. Such engagement means may be as simple as a pushing end of the rotatable launch arm, capable of pushing a rear end of a passenger carrier. Alternatively, the end of the rotatable launch arm and the passenger carrier are provided with complementary engagement means that can easily be disengaged. Such complementary engagement means may e.g. comprise magnets or a hook and ring combination. Possibly, engagement operating means are provided to automate engagement and disengagement.

Yet alternatively, the engagement means comprise a guide along which an associated guide element is moveable. Optionally, this associated guide element is connected to the one or more carriers. By providing the guide extending perpendicular to the rotation surface, the distance in axial direction between the engagement means and the launch arm support is variable according to the second aspect of the invention. By providing the guide along the length of the launch arm, the guide extends in the rotation surface making the radial distance between the engagement means and the launch arm support variable according to the first aspect of the invention. Possibly, control means control the movement of the guide element along the guide.

In a preferred embodiment, the part of the engagement means associated with the launch arm engage with a pusher carriage, provided at the rear end of the at least one passenger carrier. At the starting position, the rotatable launch arm engages with this pusher vehicle, which vehicle pushes and accelerates the one or more carriers during the launch along the launch path. At the disengagement position along said launch path the one or more passenger carriers are preferably disengaged from the pusher vehicle, e.g. by providing a downwards extending pusher carriage track. The at least one passenger carrier travels further along the amusement ride structure, while the pusher vehicle may be returned to the starting position via the pusher track. Alternatively, the passenger carrier remains engaged to the pusher vehicle, but the pusher vehicle is disengaged from the rotatable launch arm.

The launch system according to the invention is suitable for any type of amusement ride installation, including single coaches (comprising carries adapted for supporting a single passenger) and four-seaters (comprising carries adapted for supporting up to four passengers). The carriers may support the passengers in a seated position or in a standing up position. The launch system according to the invention is also suitable for carriers suspending from the ride guide structure.

The launch drive means according to the invention providing the launch arm with an angular velocity may by driven electrically, hydraulically or pneumatically, and may comprise linear motors such as a LIM (linear induction motor) or a LSM (linear synchronous motor). The launch drive means provide linear acceleration, or alternatively accelerate by application of constant power. The drive speed may increase during a launch. Preferably, breaking means are provided to break the movement of the launch arm after disengagement of the engagement means in order to decelerate back to at the starting position. It is also possible to operate the drive means such as to act as break means.

Preferably, the rotatable launch arm is fully rotatable over 360°. As a result, the launch arm can after the launch and disengagement of the engagement means rotate further to the starting position. Alternatively, the launch arm pivots back to the starting position.

The present invention also relates to a method for accelerating at least one passenger carrier adapted for supporting one or more passengers in an amusement ride installation, wherein the amusement ride installation comprises:

- at least one passenger carrier adapted for supporting one or more passengers,
- an amusement ride guide structure supporting and guiding the at least one passenger carrier,
- a launch system adapted to accelerate the at least one passenger carrier from a starting position, said launch system comprising:
  - a launch guide structure extending between the starting position and the amusement ride guide structure, supporting and guiding the at least one passenger carrier, which launch guide structure has a curvature,
  - a launch arm connected to a launch arm support, rotatable about a rotation axis in a rotation surface,
  - engagement means, at least part of which are associated with the launch arm, for providing a temporary connection between the launch arm and the at least one passenger carrier during the launch, which disengage at a disengagement position, launch drive means providing the launch arm with an angular velocity, wherein the radial distance between the engagement means and the launch arm support is variable such that portions of the launch guide structure have a deviating radius, or wherein the amusement ride installation comprises:

at least one passenger carrier adapted for supporting one or more passengers, an amusement ride guide structure supporting and guiding the at least one passenger carrier, a launch system adapted to accelerate the at least one passenger carrier from a starting position, said launch system comprising:

a launch guide structure extending between the starting position and the amusement ride guide structure, supporting and guiding the at least one passenger carrier, which launch guide structure has a curvature, a launch arm connected to a launch arm support, rotatable about a rotation axis in a rotation surface, engagement means, at least part of which are associated with the launch arm, for providing a temporary connection between the launch arm and the at least one passenger carrier during the launch, which disengage at a disengagement position, launch drive means providing the launch arm with an angular velocity, wherein the distance in axial direction between the engagement means and the launch arm support is variable such that portions of the launch guide structure have curvatures perpendicular to the surface of rotation, such as slopes or banking, said method comprising the steps of:

allowing one or more passengers to embark the carrier at a boarding station, move the carrier to the starting position, engaging the engagement means between the launch arm and the at least one passenger carrier, drive the launch drive means to provide launch arm with an angular velocity, disengage the engagement means at the disengagement position drive the launch drive means to move the launch arm to the starting position.

The carrier may be moved from the boarding station to the starting position by the launch arm if engagement takes place at the boarding station. Alternatively, the carrier is moved from the boarding station to the starting position by separately provided start drive means. This is in particular advantageous because one or more carriers may be launched from the starting position, while passengers access another set of one or more carriers at the boarding station.

Preferably, when the engagement means comprise a pusher carriage, the method comprises the steps of:

allowing one or more passengers to embark the carrier at a boarding station, move the carrier to the starting position by start drive means, engage the pusher carriage with the at least one passenger carrier and engage the launch arm to the pusher carriage, drive the launch drive means to provide launch arm and the pusher carriage with an angular velocity, disengage the pusher carriage from the at least one passenger carrier at the disengagement position, drive the launch drive means to move the pusher carriage engaged with the launch arm over a pusher track to the starting position.

It is noted that moving the carrier to the starting position by start drive means, engaging the pusher carriage with the at least one passenger carrier and engaging the launch arm to the pusher carriage may occur at any sequence.

BRIEF DESCRIPTION OF THE DRAWINGS

The invention will be discussed in more detail below referring to the drawings. In the drawings.

DETAILED DESCRIPTION OF THE DRAWINGS

Figure 1:
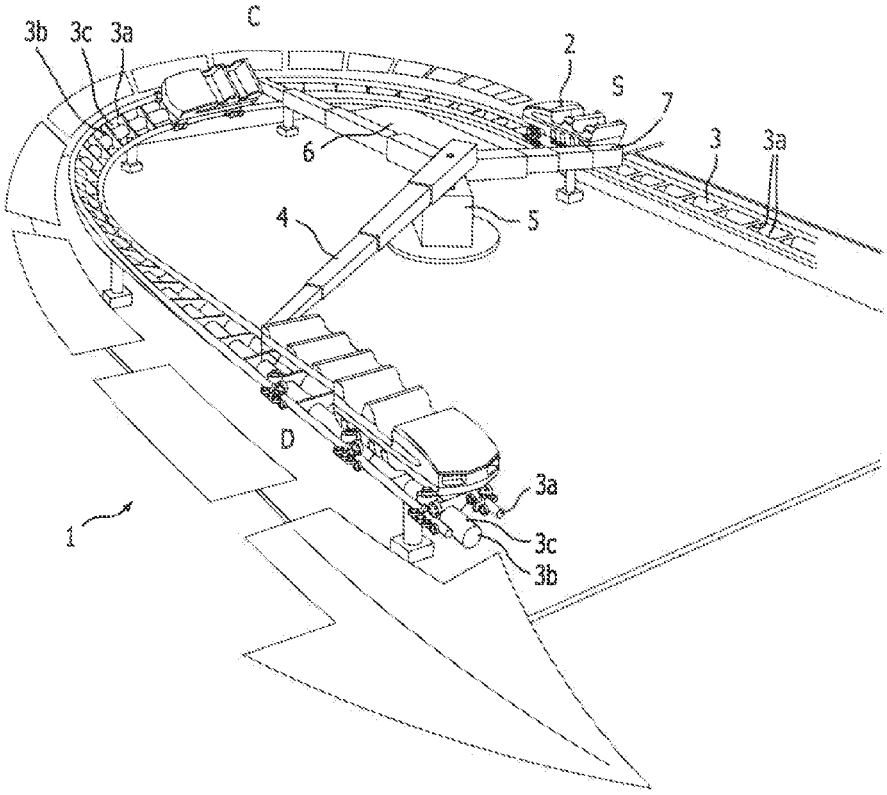
FIG. 1 shows an example of a launch system for an amusement ride installation according to the invention.

In FIG. 1 a launch system 1 for an amusement ride installation is shown. The shown amusement ride installation comprises one passenger carrier 2 adapted for supporting four passengers, and an amusement ride guide structure (not shown) supporting and guiding the at least one passenger carrier 2. Launch system 1 is adapted to accelerate the passenger carrier 2 from a starting position S. Launch system 1 comprises a launch guide structure 3 extending between the starting position S and the amusement ride guide structure (not shown), supporting and guiding the passenger carrier 2, which launch guide structure 3 has a curvature C. Carrier 2 is shown in three different positions along the launch guide structure 3. Launch guide structure 3 comprises two parallel tracks 3*a* to which the carrier 2 engage, which tracks 3*a* extend from a backbone 3*b* via a tie 3*c*.

Launch system 1 comprises a straight telescopic launch arm 4 connected to a launch arm support 5, rotatable over 360° about a substantial vertical rotation axis 6 in a rotation surface (not indicated). The launch system 1 further comprises engagement means 7, in this embodiment merely a pushing end of the launch arm 4 provided at the radial outer end of the arm 4. The engagement means 7 provide a temporary connection between the launch arm 4 and the passenger carrier 2 during the launch, and disengage at a disengagement position D. After disengagement from the carrier 2, launch arm 4 rotates further to the starting position S. In the embodiment shown in FIG. 1, engagement means 7 directly engage with the passenger carrier 2. The engagement means 7 allow a rotation of the carrier with respect to the engagement means 7 at the location of the curvature C to enable banking of the launch guide structure 3. Launch drive means (not shown) provide the launch arm 4 with an angular velocity. The angular velocity of the launch arm 4 is preferably braked in the segment between disengagement D and the starting position S, e.g. by switching the operation of electronic drive means.

The radial distance between the engagement means 7 and the launch arm support 5 is variable such that portions of the launch guide 3 structure have a deviating radius. To such extent, the launch arm is telescopic so as to be extendable in the radial outward direction. The advantage is that the carrier 2 can be quickly be accelerated. The telescopic movement is controlled by telescopic drive means (not shown), extending the launch arm 4 from the starting position S to the disengagement position D and retracting the launch arm 4 from the disengagement position S to the starting position S.

Figure 2:
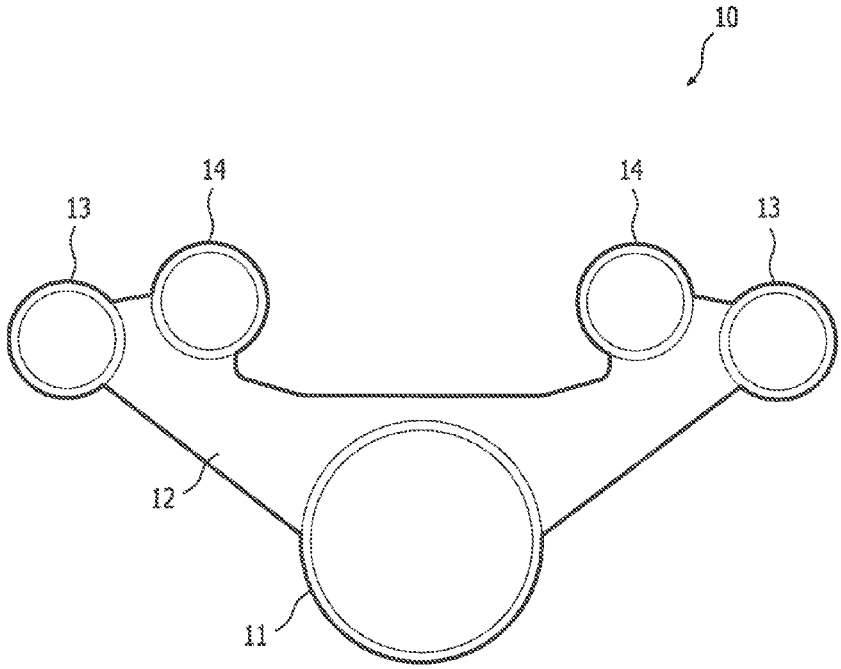
FIG. 2 shows an alternative launch guide structure
Figure 3:
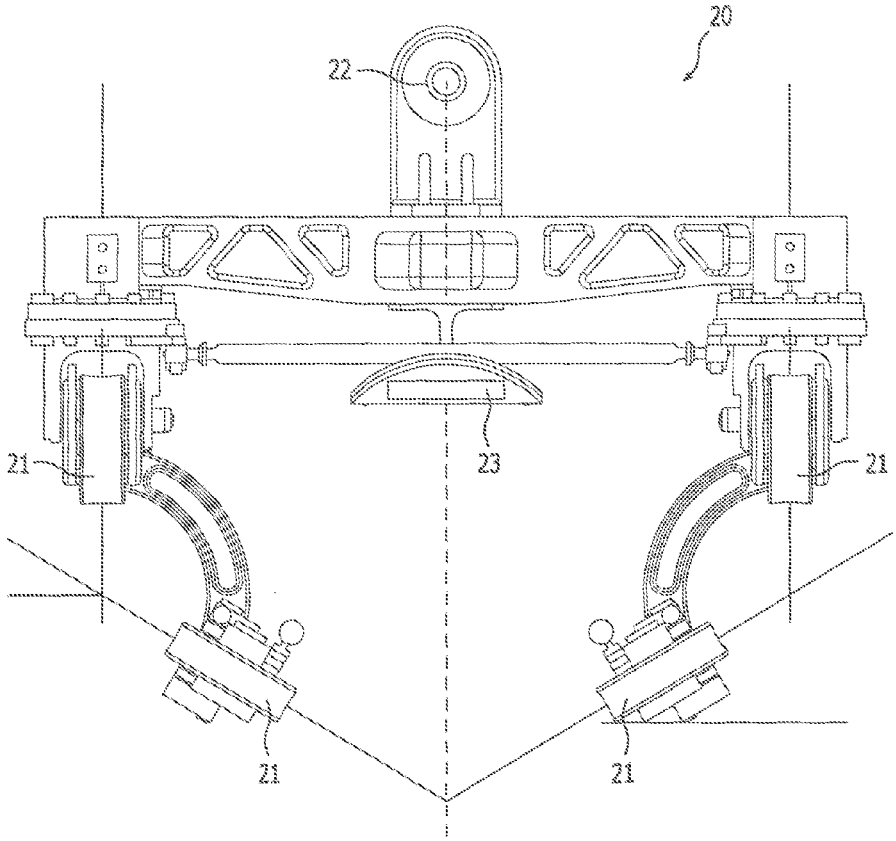
FIG. 3 shows an example of a pusher carriage according to a preferred embodiment of the invention.

In FIG. 2 a cross-section of an alternative launch guide structure 10 is shown, comprising a backbone 11 from which two carrier tracks 13 extend via a tie 12. Also, two pusher carriage tracks 14 are provided, allowing a pusher carriage (such as shown in FIG. 3) to move independently from the carrier (not shown). This enables a downwards deviation from the pusher track, and hence of the pusher carriage, to disengage the pusher carriage from the one or more passenger carriers. The launch arm may remain engaged to the pusher carriage. Alternatively, the launch arm is disengaged from the pusher carriage and the carriage moves back to the starting position independently, e.g. by separately provided pusher carriage drive means.

FIG. 3 shows an example of a pusher carriage 20 according to a preferred embodiment of the invention to move on a launch guide structure 10 as shown in FIG. 2. The pusher carriage 20 engages with the pusher carriage tracks 14 via wheels 21. Engagement means 22 are provided symmetrically to enable engagement of the pusher carriage with a passenger carrier on the one hand, and to enable engagement with the engagement means associated with the launch arm on the other hand. Electromagnetic breaking means 23 may be provided to break the movement of the pusher carriage. Any other type of breaking means may be provided to break the speed of the pusher carriage from the disengagement position to a static position at the starting position.

The invention claimed is:

1. An amusement ride installation, comprising:

at least one passenger carrier adapted for supporting one or more passengers, an amusement ride guide structure supporting and guiding the at least one passenger carrier, a launch system adapted to accelerate the at least one passenger carrier from a starting position, said launch system comprising:

a launch guide structure extending between the starting position and the amusement ride guide structure, supporting and guiding the at least one passenger carrier, which launch guide structure has a curvature, a launch arm connected to a launch arm support, rotatable about a rotation axis in a rotation surface, an engagement device, at least part of which is associated with the launch arm, configured to provide a temporary connection between the launch arm and the at least one passenger carrier during the launch, which disengages at a disengagement position, and a launch drive configured to provide the launch arm with an angular velocity, wherein the radial distance between the engagement device and the launch arm support is variable such that portions of the launch guide structure have a deviating radius, and wherein the engagement device is provided at the radial outer end of a rotatable launch arm, said launch arm being telescopic so as to extend in the radial outward direction.

2. The amusement ride installation according to claim 1, wherein the rotatable launch arm is connected pivotably to the launch arm support, wherein the pivot axis extends in the rotation surface, so as to allow the launch arm to pivot in a direction perpendicular to the rotation surface.

3. The amusement ride installation according to claim 1, wherein the engagement device comprises a guide extending along the length of the launch arm, along which guide an associated guide element is moveable in the rotation surface.

4. The amusement ride installation according to claim 1, wherein the engagement device associated with the launch arm directly engages with a passenger carrier.

5. The amusement ride installation according to claim 1, wherein the engagement device associated with the launch arm engages with a pusher carriage, which pusher carriage pushes the one or more passenger carriers during the launch.

6. The amusement ride installation according to claim 1, wherein an electronic launch drive is configured to provide the launch arm with angular velocity.

7. The amusement ride installation according to claim 1, wherein the launch drive provides an increasing drive speed.

8. The amusement ride installation according to claim 1, wherein the launch guide structure is adapted to support a suspended passenger carrier.

9. The amusement ride installation according to claim 1, wherein the rotatable launch arm is fully rotatable over 360°, such that after a passenger carrier is disengaged from the rotatable launch arm the arm can rotate further to the starting position.

10. The amusement ride installation according to claim 1, wherein the radial distance between the engagement device and the launch arm support increases from a relatively small distance at the starting position to a relatively large distance at the disengagement position.

11. A method for accelerating at least one passenger carrier adapted for supporting one or more passengers in an amusement ride installation according to claim 1, comprising the steps of:

allowing one or more passengers to embark the carrier at a boarding station, moving the carrier to the starting position, engaging the engagement device between the launch arm and the at least one passenger carrier, driving the launch drive to provide launch arm with an angular velocity, disengaging the engagement device at the disengagement position, and driving the launch drive to move the launch arm to the starting position.

12. The method according to claim 11, wherein the engagement device comprises a pusher carriage, which method comprises the steps of:

allowing one or more passengers to embark the carrier at a boarding station, moving the carrier to the starting position, engaging the pusher carriage with the at least one passenger carrier and engaging the launch arm to the pusher carriage, driving the launch drive to provide launch arm and the pusher carriage with an angular velocity, disengaging the pusher carriage from the at least one passenger carrier at the disengagement position, driving the launch drive to move the pusher carriage engaged with the launch arm over a pusher track to the starting position.

13. An amusement ride installation, comprising:

at least one passenger carrier adapted for supporting one or more passengers, an amusement ride guide structure supporting and guiding the at least one passenger carrier, a launch system adapted to accelerate the at least one passenger carrier from a starting position, said launch system comprising:

a launch guide structure extending between the starting position and the amusement ride guide structure, supporting and guiding the at least one passenger carrier, which launch guide structure has a curvature, a launch arm connected to a launch arm support, rotatable about a rotation axis in a rotation surface, an engagement device, at least part of which is associated with the launch arm, configured to provide a temporary connection between the launch arm and the at least one passenger carrier during the launch, which disengages at a disengagement position, and a launch drive configured to provide the launch arm with an angular velocity, wherein the distance in an axial direction between the engagement device and the launch arm support is variable such that portions of the launch guide structure have curvatures perpendicular to the surface of rotation, and wherein the engagement device is provided at the radial outer end of a rotatable launch arm, said launch arm being telescopic so as to extend in the radial outward direction.

14. The amusement ride installation according to claim 13, wherein the rotatable launch arm is connected pivotably to the launch arm support, wherein the pivot axis extends in the rotation surface, so as to allow the launch arm to pivot in a direction perpendicular to the rotation surface.

15. The amusement ride installation according to claim 13, wherein the engagement device comprises a guide extending along the length of the launch arm, along which guide an associated guide element is moveable in the rotation surface.

16. The amusement ride installation according to claim 15, wherein the associated guide element is connected to the at least one carrier.

17. The amusement ride installation according to claim 13, wherein the engagement device associated with the launch arm directly engages with a passenger carrier.

18. The amusement ride installation according to claim 13, wherein the engagement device associated with the launch arm engages with a pusher carriage, which pusher carriage pushes the one or more passenger carriers during the launch.

19. The amusement ride installation according to claim 13, wherein an electronic launch drive is configured to provide the launch arm with angular velocity.

20. The amusement ride installation according to claim 13, wherein the launch drive provides an increasing drive speed.

21. The amusement ride installation according to claim 13, wherein the launch guide structure is adapted to support a suspended passenger carrier.

22. The amusement ride installation according to claim 13, wherein the rotatable launch arm is fully rotatable over 360°, such that after a passenger carrier is disengaged from the rotatable launch arm the arm can rotate further to the starting position.

23. The amusement ride installation according to claim 13, wherein the radial distance between the engagement means and the launch arm support increases from a relatively small distance at the starting position to a relatively large distance at the disengagement position.

24. The method for accelerating at least one passenger carrier adapted for supporting one or more passengers in an amusement ride installation according to claim 13, comprising the steps of:

allowing one or more passengers to embark the carrier at a boarding station, moving the carrier to the starting position, engaging the engagement device between the launch arm and the at least one passenger carrier, driving the launch drive to provide launch arm with an angular velocity, disengaging the engagement device at the disengagement position, and driving the launch drive to move the launch arm to the starting position.

25. The amusement according to claim 24, wherein the engagement means comprise a pusher carriage, which method comprises the steps of:

allowing one or more passengers to embark the carrier at a boarding station, moving the carrier to the starting position, engaging the pusher carriage with the at least one passenger carrier and engaging the launch arm to the pusher carriage, driving the launch drive to provide launch arm and the pusher carriage with an angular velocity, disengaging the pusher carriage from the at least one passenger carrier at the disengagement position, driving the launch drive to move the pusher carriage engaged with the launch arm over a pusher track to the starting position.

26. An amusement ride installation, comprising:

at least one passenger carrier adapted for supporting one or more passengers, an amusement ride guide structure supporting and guiding the at least one passenger carrier, a launch system adapted to accelerate the at least one passenger carrier from a starting position, said launch system comprising:

a launch guide structure extending between the starting position and the amusement ride guide structure, supporting and guiding the at least one passenger carrier, which launch guide structure has a curvature, a launch arm connected to a launch arm support, rotatable about a rotation axis in a rotation surface, an engagement device, at least part of which are associated with the launch arm, configured to provide a temporary connection between the launch arm and the at least one passenger carrier during the launch, which disengages at a disengagement position, and a launch drive device configured to provide the launch arm with an angular velocity, wherein the radial distance between the engagement means and the launch arm support is variable such that portions of the launch guide structure have a deviating radius, and wherein the engagement device comprises a guide extending along the length of the launch arm, along which guide an associated guide element is moveable in the rotation surface.

27. An amusement ride installation, comprising:

at least one passenger carrier adapted for supporting one or more passengers, an amusement ride guide structure supporting and guiding the at least one passenger carrier, a launch system adapted to accelerate the at least one passenger carrier from a starting position, said launch system comprising:

a launch guide structure extending between the starting position and the amusement ride guide structure, supporting and guiding the at least one passenger carrier, which launch guide structure has a curvature, a launch arm connected to a launch arm support, rotatable about a rotation axis in a rotation surface, an engagement device, at least part of which are associated with the launch arm, configured to provide a temporary connection between the launch arm and the at least one passenger carrier during the launch, which disengages at a disengagement position, and a launch drive device configured to provide the launch arm with an angular velocity, wherein the radial distance between the engagement means and the launch arm support is variable such that portions of the launch guide structure have a deviating radius, and wherein the radial distance between the engagement device and the launch arm support increases from a relatively small distance at the starting position to a relatively large distance at the disengagement position.

* * * * *